US005692930A

United States Patent [19]

Garver et al.

[11] Patent Number: 5,692,930

[45] Date of Patent: Dec. 2, 1997

[54] ELECTRICAL DISTRIBUTION SYSTEM CONNECTOR

[75] Inventors: William Joseph Garver, Harrisburg, Pa.; Roland Paul Heinrichs, Pilot, N.C.; Hung Viet Ngo, Harrisburg, Pa.

[73] Assignee: The Whitaker Corporation, Wilmington, Del.

[21] Appl. No.: 683,352

[22] Filed: Jul. 18, 1996

[51] Int. Cl.[6] ..... H01R 4/44

[52] U.S. Cl. ..... 439/781; 439/782

[58] Field of Search ..... 439/781, 782

[56] References Cited

U.S. PATENT DOCUMENTS 3,177,459 4/1965 Toedtman ..... 439/781

4,915,653 4/1990 Mair ..... 439/781

5,092,797 3/1992 Cole et al. ..... 439/783

5,281,173 1/1994 Cherry et al. ..... 439/783

*Primary Examiner*—Neil Abrams

*Assistant Examiner*—T. C. Patel

[57] ABSTRACT

The invention comprises an electrical connector with a clamp member having two opposing channels for receiving conductors therein. The channels extend longitudinally along a length of the clamp member. The opposing channels are connected together by an intermediate portion. The intermediate portion has a web and an inner loop to provide inherent resiliency in the clamp member. The connector also has a wedge member to be received within the clamp member between the opposed channels. The wedge member is driven within the clamp member in a lateral direction by a bolt. The bolt connects the clamp member to the wedge member.

26 Claims, 5 Drawing Sheets

ELECTRICAL DISTRIBUTION SYSTEM CONNECTOR

FIELD OF THE INVENTION

The present invention relates to electrical connectors for electrically connecting and mechanically securing two cables together by the use of a cooperating clamp member and a wedge block.

BACKGROUND OF THE INVENTION

It is known to electrically connect and mechanically secure two cables using a C-shaped resilient clamp and a wedge, by wedging the cables within the clamp. The pressure between the wedge and the C-shaped clamp secures the cables therebetween providing good electrical and mechanical connection.

U.S. Pat. No. 4,915,653 shows an electrical connector having a C-shaped member and a wedge block for positioning and securing cables therebetween. The wedge block has slanted sides which engage and compress the cable. The wedge block is secured within the C-shaped member by being pulled laterally through the mouth of C-shaped member into the interior of the C-shaped member. The wedge block is pulled into the C-shaped member in a direction perpendicular to the direction of the cables. The wedge is secured therein using a bolt. The C-shaped member has resiliency to provide spring action against the cable. The slanted sides of the wedge block provide extra resiliency against the cable when the connector is secured.

What is needed is a connector wherein the wedge block is pulled in laterally, or perpendicular to the cables, into the C-shaped member and wherein the C-shaped member has more inherent resiliency to provide better electrical connection to the conductors. Further, better resiliency would allow the electrical connector to accommodate a greater variety of sizes of the electrical conductors.

U.S. Pat. No. 5,281,173 discloses an electrical connector for an electrical distribution system having a clamp member and a wedge member. The clamp member has a bight portion which includes a double loop. The bight and the double loop combination provide the clamp member with greater resiliency so that the clamp member can accommodate a variety of conductor wire sizes. The wedge member is inserted into the clamp member in a direction parallel to the direction of the cables.

SUMMARY OF THE INVENTION

The invention comprises an electrical connector with a clamp member having two opposing channels for receiving conductors therein. The channels extend longitudinally along a length of the clamp member. The opposing channels are connected together by an intermediate portion. The intermediate portion has a web and an inner loop to provide inherent resiliency in the clamp member. The connector also has a wedge member to be received within the clamp member between the opposed channels. The wedge member is driven within the clamp member in a lateral direction by a bolt. The bolt connects the clamp member to the wedge member.

BRIEF DESCRIPTION OF THE INVENTION

Embodiments of the invention will now be described with the reference to the accompanying drawings, in which.

DETAILED DESCRIPTION OF THE INVENTION

Figure 1:
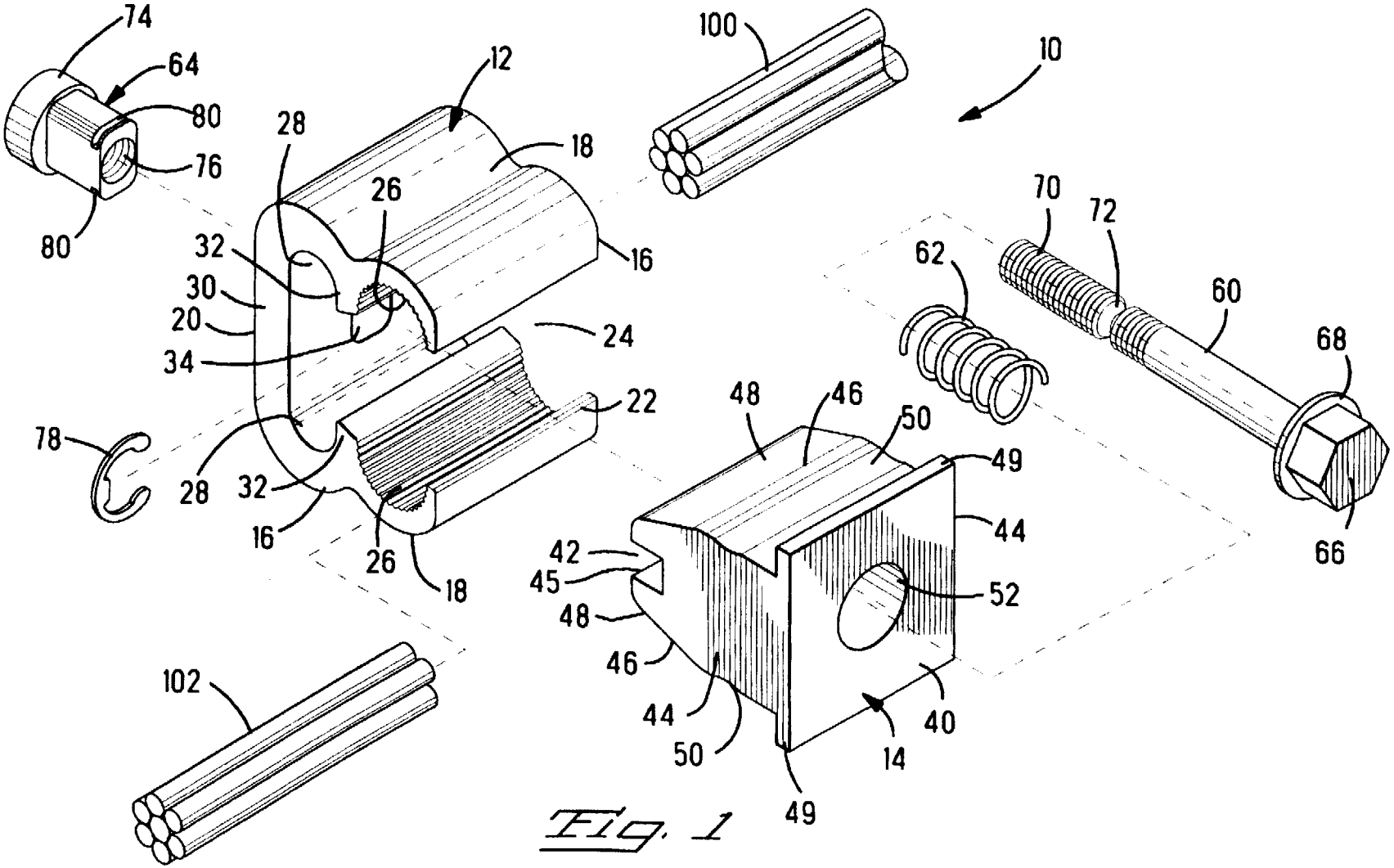
FIG. 1 is an exploded isometric view of the electrical connector of the present invention.

FIG. 1 shows one embodiment of the electrical connector of the present invention. The electrical connector can be used to electrically connect a tap cable or conductor to a through cable or conductor, for example, to provide power to the tap cable or conductor.

Electrical connector 10 comprises a clamp member 12 and a wedge member 14. The clamp member 12 has ends 16 sides 18, a bottom 20, and a top 22. Along the top 22 is mouth 24. The top portion of the sides 18 are rolled over to the defined channel portions 26. The channel portions 26 extend longitudinally along the length of the clamp member 12, from one end 16 to the other end 16. The channel portions 26 have parallel serrations to bite into the cable during termination. Alternatively, the channel portions could have some other type of surface, either smooth or some other texture to provide a good gripping surface. Along both of the sides 18, towards the bottom, are inner loops 28. Separating the two inner loops 28 is a web portion 30. The inner loops 28 are separated from the channel portions 26 by inner bight 32 which extends into the interior of the clamp member 12, thereby forming a double loop along each of the sides 18 of the clamp member 12. Along the web portion 30 is opening 34 which extends from the exterior of the clamp 12 into the interior of the clamp.

The wedge member 14 has a top surface 40, a bottom surface 42, ends 44, and sides 46. Along both of the sides 46, towards the bottom of the clamp member 12, are chamfered sections 48. The chamfered sections 48 provide ease of insertion of the wedge member into the clamp member. Along either of the sides 46 are two channel portions 50. The channel portions 50 extend in the longitudinal direction along the sides of the wedge, from one end 44 to the other end 44. When the wedge member 14 is received within the clamp member 12 the channel portions 26 and the channel portions 50 cooperate to define a channel for receiving conductors therebetween. Along the top 40 are projections 49 which provide ease of handling the wedge during termination and untermination. The projections 49 also prevent the cable from pulling out of the connector 10 following termination. The wedge member 14 has a bolt receiving hole 52 which extends from the top surface 40 to the bottom surface 42. The bolt receiving hole 52 extends perpendicular to the channel portions 50. The wedge member 14 has tool opening 45 which is disposed along the bottom side and extends from one end 44 to the other end 44, see FIGS. 1 and 6.

The electrical connector 10 further comprises a bolt member 60, a spring 62, and a bolt receptacle 64. The bolt member 60 has a head 66 with either a separate washer or an integral washer head 68, as is shown in FIG. 1. The bolt 60 also has threaded portion 70 and a frangible portion 72.

The bolt receptacle 64 includes a head 74 and a hole 76 with threads therein to receive and engage the threaded portion 70 of the bolt. The bolt receptacle 64 is to be received within opening 34. The head 74 will engage the exterior surface of the clamp member 12 and the grooves 80 will be received within the interior of the clamp member 12. The electrical connector also includes a C-shaped locking ring 78. When the bolt receptacle 64 is received through the opening 34 on the clamp member the lock ring 78 is received within grooves 80 of the bolt receptacle. The C-shaped locking ring 78 will engage the interior wall of the web portion 30 thereby locking the bolt receptacle onto the clamp member, see FIG. 6.

Figure 6:
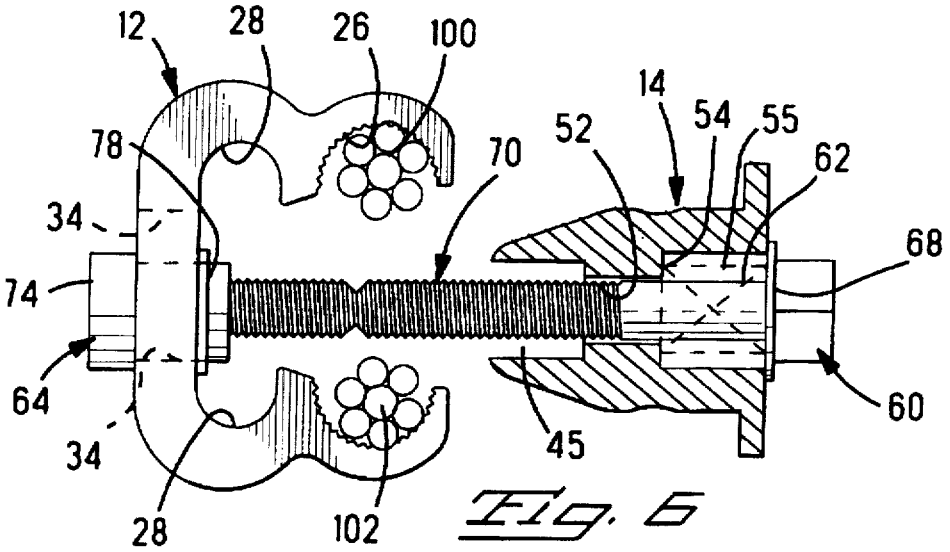
FIG. 6 is a cross-sectional view of the electrical connector showing the wedge in the pre-load position.

The electrical connector is used to secure two cables 100, 102 together, as is shown in FIG. 1. FIG. 6 shows a cross-sectional view of the partially assembled electrical connector of the present invention. In this view, it can be seen that the bolt receiving hole 52 on the wedge also has recess 55 which is slightly larger than the rest of the opening. This recess has a shoulder 54 which engages the bottom portion of the spring 62 securing the spring within the bolt receiving hole 52. The other end of the spring 62 is secured against the washer 68 on the bolt member 60. The bolt member 60 is received through the bolt receiving hole 52 and then engages the hole 76 on the bolt receptacle 64. The threaded portion 70 of the bolt will engage the threads within the hole 76 on the bolt receptacle 64 thereby securing the wedge 14 to the clamp member 12.

It can be seen from FIGS. 2–8 that the wedge is received within the mouth 24 of the clamp member so that the clamp wedge can be pulled down in the lateral direction into the interior of the clamp member.

The operation of the electrical connector 10 will now be described with reference to FIGS. 2–8. Electrical connector 10 is first assembled so that the wedge member 14 is secured to the clamp member 12 by the bolt 60. The bolt 60 is only partially inserted into the bolt receptacle 64 so that there is spring tension between the washer 68 and the wedge member 14. The wedge 14 can be moved by pushing the wedge against the spring 62 thereby moving the wedge in lateral direction with respect to the channels, out of the interior of the clamp member 12. The wedge member 14 is moved out of the interior of the clamp member against the spring thereby compressing the spring into the recess 55 within the wedge member. In this position the wedge is completely removed from the interior of the clamp member thereby allowing insertion of cables into the channel portions 26.

Figure 2:
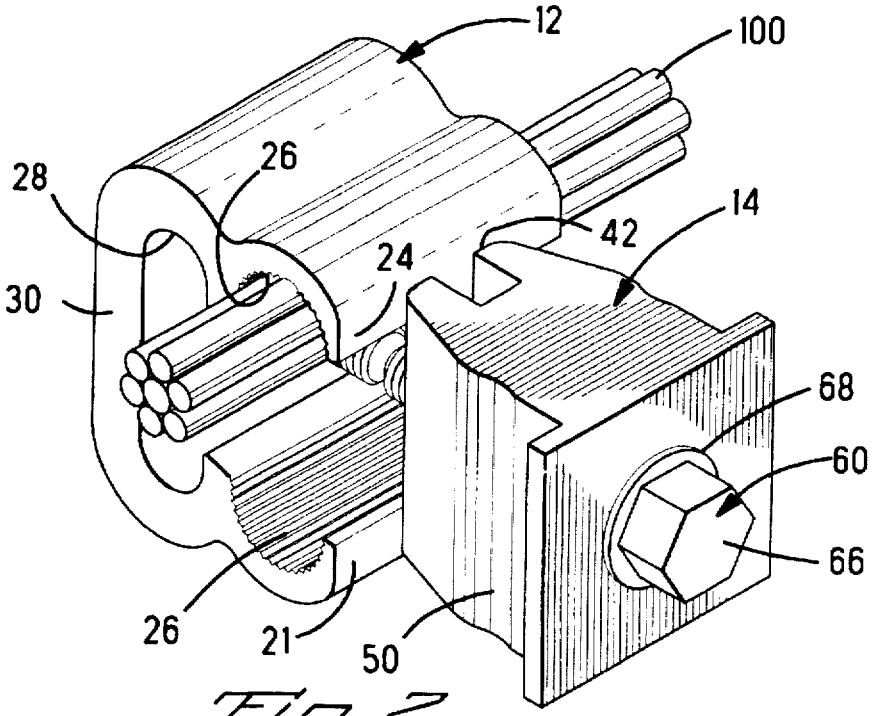
FIG. 2 is an isometric view of the electrical connector showing one cable installed within the connector.
Figure 3:
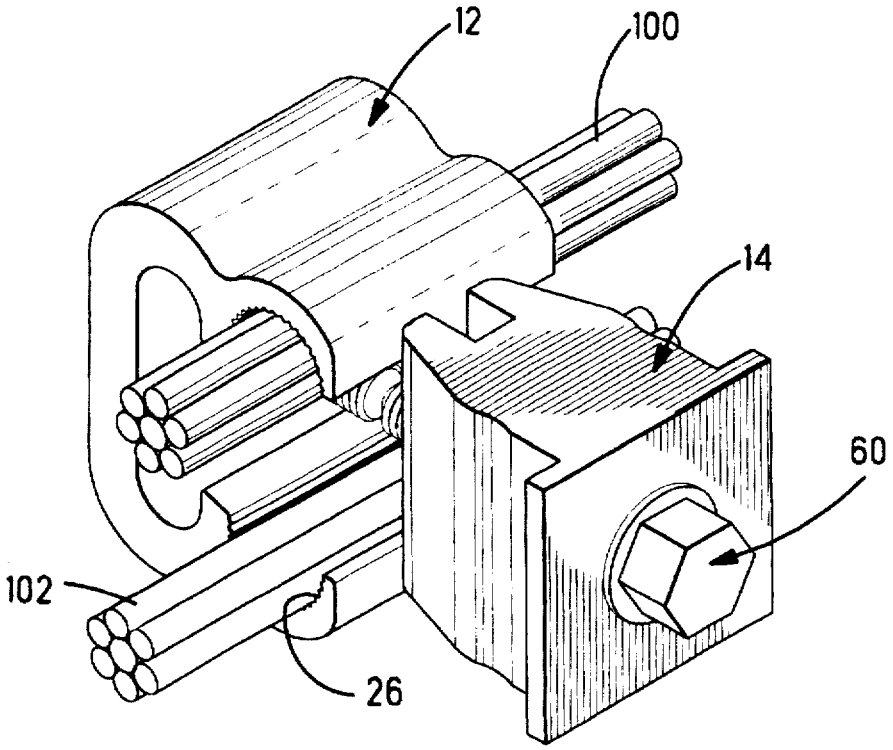
FIG. 3 is an isometric view of the electrical connector showing the operation of the wedge.
Figure 4:
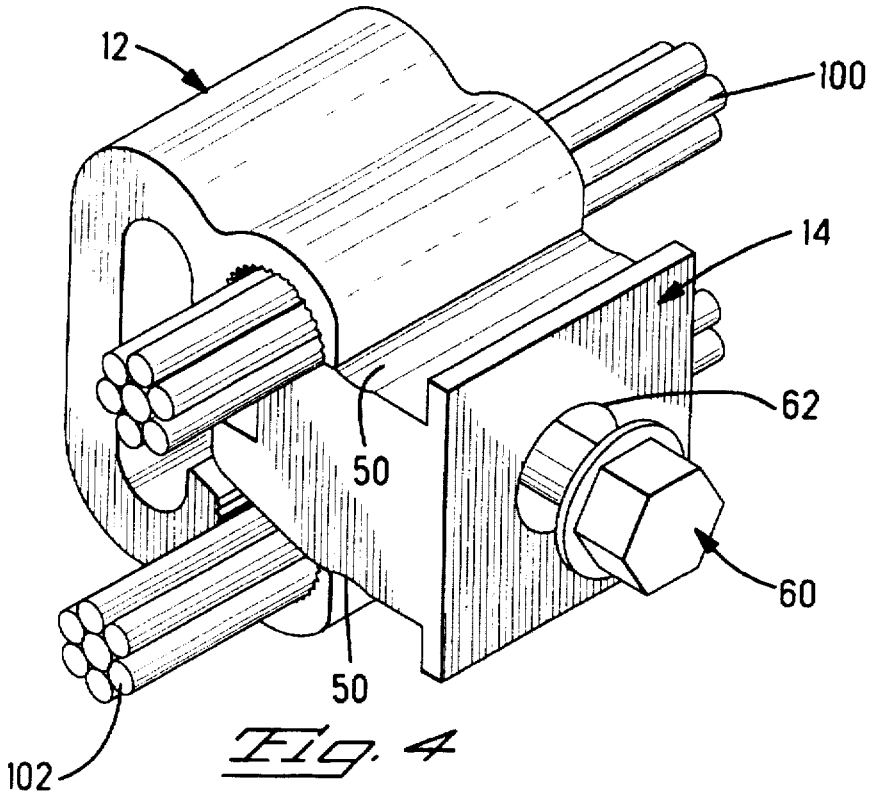
FIG. 4 is an isometric view showing the wedge partially inserted within the clamp member.
Figure 5:
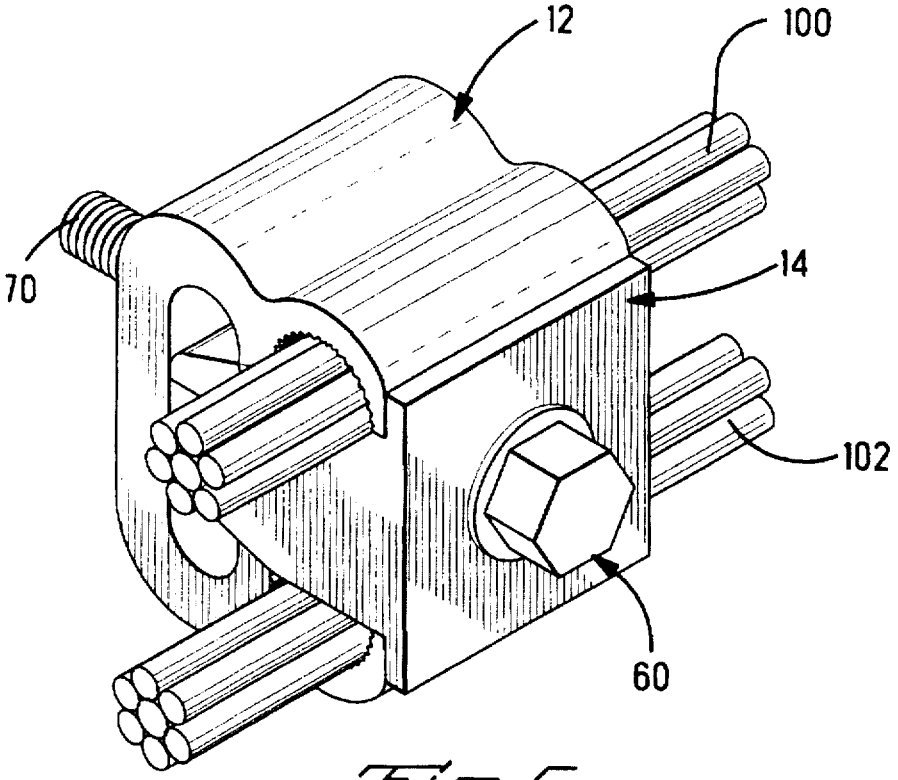
FIG. 5 is an isometric view showing the electrical connector fully assembled.
Figure 7:
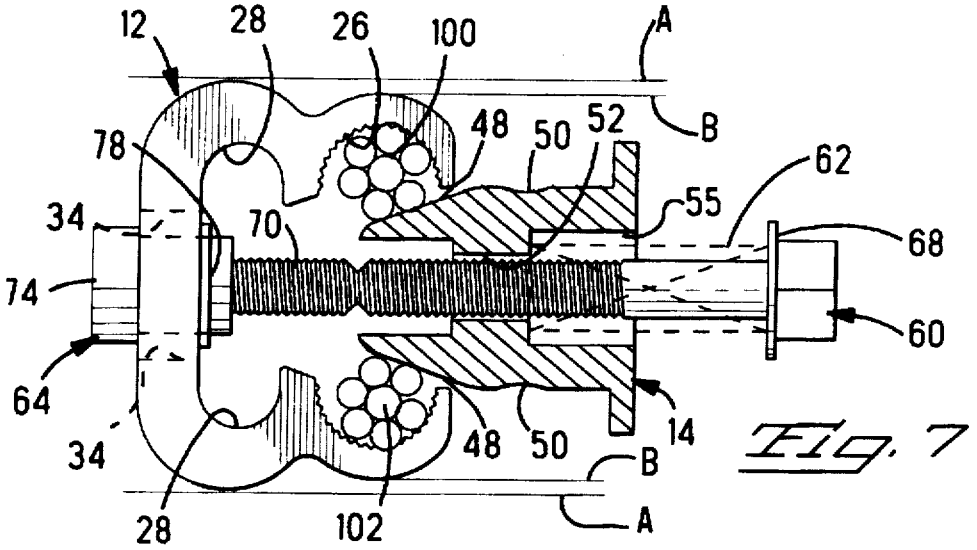
FIG. 7 is a cross-sectional view of the electrical connector showing the wedge partially inserted within the clamp member.
Figure 8:
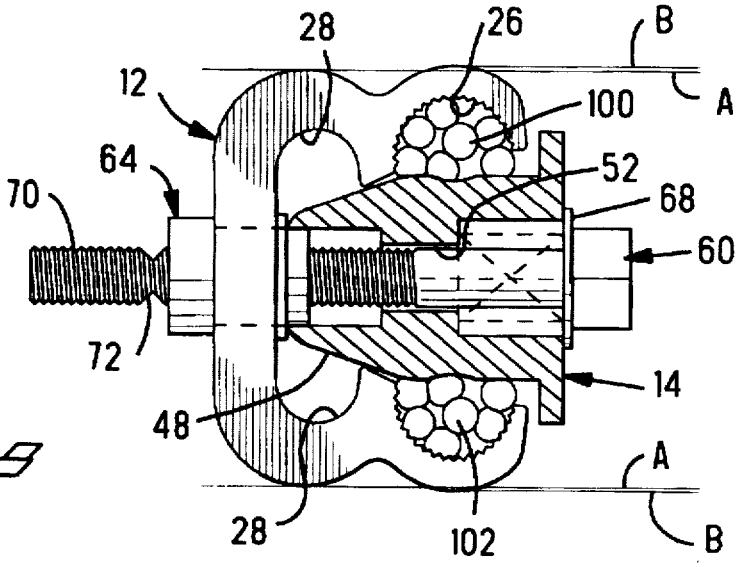
FIG. 8 is a cross-sectional view showing the electrical connector fully assembled.

To further allow insertion of cables, the opening 34 extends laterally, towards the sides 18 of the clamp member 12, as is shown in FIGS. 6 and 7, to allow side to side movement of the bolt receptacle within the opening, so that the wedge can be moved from side to side as shown in FIG. 6. When the wedge member 14 is moved to one side, there is additional room for insertion of a cable 100. In the first operation, the wedge 14 is pulled out of the interior of the clamp 12 and pushed off to the one side so that the through cable 100 can be received into the channel 26. This is accomplished by pulling the electrical connector over the through cable 100. The wedge 14 can then be twisted, as is shown in FIG. 2, and spring pressure will then push the wedge against the clamp member thereby securing the bottom of the wedge against the top of the clamp. The through cable 100 is thereby secured within the clamp member and the operator can release his grasp on the connector because it is secured to the through cable 100. It is then possible to feed a tap cable 102 through the other channel portion, as is shown in FIG. 3. The wedge is then pulled back away from the clamp member and is twisted back into its normal position, as is shown in FIG. 6, and inserted through the mouth 24 of the clamp member, as shown in FIGS. 4 and 7, thereby temporarily securing the cables within the channel portions 26. The chamfered sections 48 temporarily engage the cables 100, 102, securing them loosely within the connector 10. By screwing the bolt down, the washer 68 will push against the wedge and the wedge will be driven completely into the interior of the clamp 12, so that channels 50 are aligned to receive the cables 100, 102. Only the projection 49 will extend along the top 16 of the clamp, as is shown in FIGS. 5 and 8. As was described earlier, the projection 49 will prevent the cable from being pulled out of the top of the clamp member 12 after termination. In this position the frangible portion 72 on the bolt is received on the exterior of the clamp member 14, outside of the receptacle 64, so that the end of the bolt can be snapped off. Removal of the end of the bolt will prevent snagging or obstruction of further operations.

Because the wedge member 14 is securely held within the clamp member 12, the wedge member 14 will remain in the clamp member 12 if the bolt 60 is removed. In order to remove the wedge member 14 from the clamp member 12, the bolt 60 is first removed. The bolt 60 is then screwed through the bolt receptacle 64 from the bottom 20 of the clamp member 12 into the interior of the clamp member. A screw driver, or some other blocking member, is placed through the opening 45 to block the bolt receiving hole 52. As the bolt 60 is screwed further into the interior, the end of the bolt will engage the screw driver and push the screw driver, which will then push the wedge member 14, thereby pushing the wedge member 14 out of the interior of the clamp member 12.

The advantage of having the inner loop portion on the clamp member 14 will now be described. The inner loop provides greater inherent resiliency in the clamp member, thereby allowing the clamp member to be used for a variety of different sizes of cables. In a normal C-shaped member, all of the resiliency comes from the flexing of the rounded open loops or the channels and also from the web portion which extends between the channels. In the clamp member of the present invention additional resiliency is found in the inner loop 28. The initial flexure of the clamp member will come about by pushing out the sides of the clamp member and through rotation of the inner loop 28 as is shown in FIGS. 7 and 8. Initially, the outer side, line A, of the inner loop extends further out than the outer side of the channel portion 26, line B, as can be seen in FIG. 7. As pressure is asserted against the clamp member 14 by the insertion and termination of cables, the inner loop 28 is rotated outward so that the outer side of the channel portion 26 becomes aligned with, or extends further out than, the outer side of the inner loop 28. Any additional resiliency will come from additional flexure of the inner loop and from flexure of the channel portion 26 and the web 30. This combination provides for greater inherent resiliency in the clamp member than is provided in a normal C-shaped member, thereby allowing the clamp member to accommodate a much greater variety of sizes of cables while still providing good clamping force.

Figure 11:
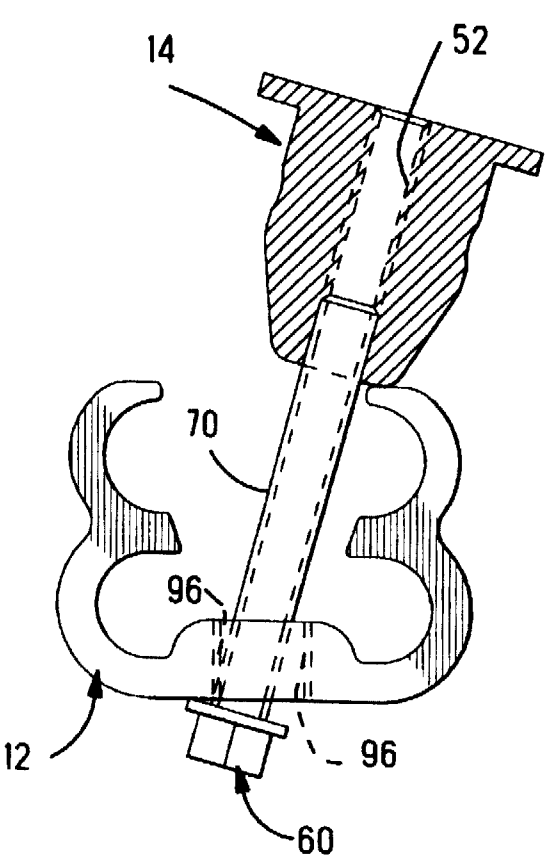
FIG. 11 is a cross-sectional view showing another alternative embodiment of the electrical connector.
Figure 10:
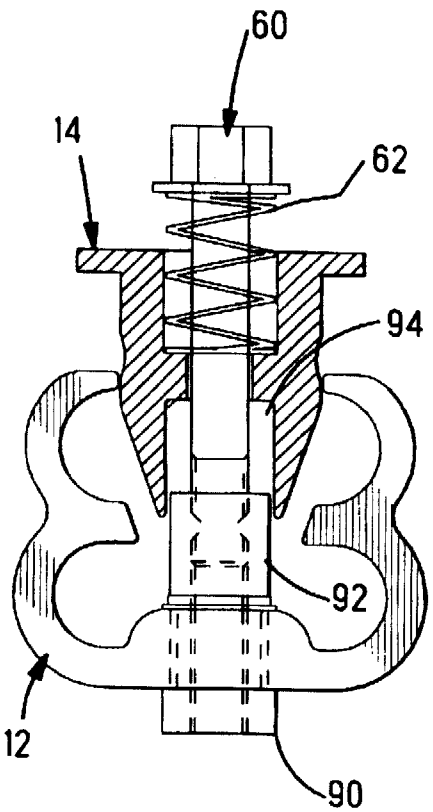
FIG. 10 is a cross-sectional view showing another alternative embodiment of the electrical connector.
Figure 9:
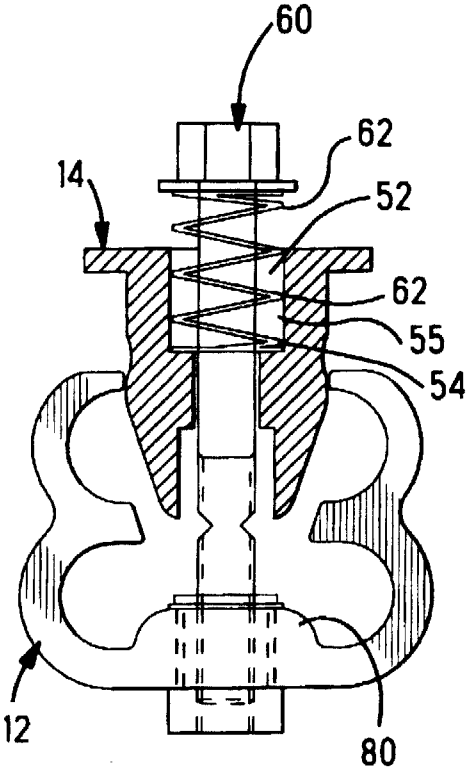
FIG. 9 is a cross-sectional view of an alternative embodiment of the electrical connector of the present invention.

Alternative embodiments will now be described with reference to FIGS. 9, 10 and 11 in which like features will have the same reference numerals. FIG. 9 shows an alternative embodiment of the clamp member 14 wherein the interior of the clamp has protrusion 80 which extends around the opening 34. FIG. 10 shows a clamp member 14 with a similar protrusion 80 and with a bolt receptacle 64 which is received within the clamp member. The receptacle 64 has a sleeve portion 92 which extends upwardly from the receptacle into the interior of the clamp member. The wedge member 14 has a recess 94 which will accommodate the sleeve 92 when the wedge is fully installed within the clamp member. The bolt member 60 as shown in FIG. 10, is much shorter than the bolt described earlier at 60 because the sleeves extend upwardly to engage it at a higher position, therefore when the electrical connector is fully assembled the bolt will not extend beyond the bottom surface of the clamp member so there is no need to break off the excess length of the bolt.

FIG. 10 shows another alternative embodiment where in the head of the bolt is secured along the bottom of the clamp member, therefore when the bolt is screwed down the wedge will be pulled within the interior of the clamp member. The opening 96 on the clamp member is a screw hole with threads therein. The opening 96 is larger than the threaded portion 70 of the bolt 60. The opening 96 allows the bolt to move from side to side so that the wedge member 14 can be moved to the side to allow insertion of a cable within the connector 10. There are two methods for removing the wedge from the connector following termination of the cables. The first method involves partially removing the bolt 60. It is then possible to remove the wedge member 14 by tapping on the head of the bolt until the wedge member 14 is forced out of the clamp member 12. Alternatively, the bolt 60 can be completely removed leaving the wedge member 14 firmly secured within the clamp member 12. A larger bolt, having a larger threaded portion, can be inserted through the opening 96 and as it is screwed through the opening, it will engage the bottom of the wedge and it will force the wedge member 14 out of the clamp member 12.

The advantages of the present invention are that the electrical connector can accommodate a wider variety of cables than the traditional C and wedge electrical connector. Further, the wedge can be installed within the clamp member using nothing more than a wrench or other common tools. No special tool is necessary for assembly.

The electrical connector of the present invention and many of the attendant advantages will be understood from the foregoing description. It is apparent that these changes may be made in the form, construction, an arrangement of parts thereof without departing from the spirit or scope of the invention, or sacrificing all of its material advantages.

What is claimed is:

1. An electrical connector, comprising:

a clamp member having two opposing channels for receiving conductors therein, the channels extending longitudinally along a length of the clamp member, the opposing channels being connected together by an intermediate portion, the intermediate portion having a web and an inner loop to provide inherent resiliency in the clamp member;

a wedge member to be received within the clamp member between the opposed channels, the wedge member being driven within the clamp member in a lateral direction by a bolt, the bolt connecting the clamp member to the wedge member; and a spring member being received around the bolt to allow the wedge to be springably maintained against the clamp member.

2. The electrical connector of claim 1, wherein the clamp member has two sides with an inner loop along each of the two sides, the inner loop and the opposing channels forming a double loop.

3. The electrical connector of claim 1, wherein the clamp member has an opening along the web, the opening having a bolt receiving receptacle therein to engage threads on the bolt and to secure the wedge member to the clamp member.

4. The electrical connector of claim 1, wherein the spring member is received between a head of the bolt and the wedge.

5. The electrical connector of claim 1, wherein the bolt has a frangible portion which can be broken to remove excess length of the bolt following termination.

6. The electrical connector of claim 3, wherein the bolt receiving receptacle has a sleeve which extends into the interior of the clamp member.

7. The electrical connector of claim 6, wherein the wedge member has a recess to receive the sleeve during termination.

8. The electrical connector of claim 1, wherein a hole extends through the web of the clamp member, a head of the bolt being received against the web and a threaded portion of the bolt being received within an interior of the clamp member, the bolt being received through a bottom of the wedge member to pull the wedge member into the interior of the clamp member.

9. The electrical connector of claim 8, wherein the hole which extends through the web is larger than the threaded portion of the bolt, the hole being threaded to receive a larger, second bolt to push the wedge member out of the interior of the clamp member following termination.

10. The electrical connector of claim 3, wherein the bolt receiving receptacle has a head which is received along an exterior of the clamp member and grooves which are received along an interior of the clamp member, a locking ring is received into the grooves to secure the bolt receptacle within the opening.

11. The electrical connector of claim 10, wherein the hole extends laterally toward side walls of the clamp member, the bolt receptacle being free to move from side to side so that the wedge member can be moved from side to side for ease of insertion of a cable into one of the opposing channels.

12. An electrical connector for connecting two cables together, comprising:

a clamp member having opposed channels for receiving the cables therein, the opposed channels being connected by an intermediate portion having inherent resiliency therein;

a wedge member to be received within the clamp member between the opposed channels;

a bolt extending laterally and connecting the clamp member with the wedge member, the wedge member being driven in a lateral direction into the clamp member by the operation of the bolt; and a spring member is received around the bolt to allow the wedge to be springably maintained against the clamp member.

13. The electrical connector of claim 12, wherein the clamp member has two sides with an inner loop along each of the two sides, the inner loop and the opposing channels forming a double loop.

14. The electrical connector of claim 12, wherein the clamp member has a opening along the web, the opening having an bolt receiving receptacle therein to engage threads on the bolt and to secure the wedge member to the clamp member.

15. The electrical connector of claim 12, wherein the spring member being received between a head of the bolt and the wedge.

16. The electrical connector of claim 12, wherein the bolt has a frangible portion which can be broken to remove excess length of bolt following termination.

17. The electrical connector of claim 14, wherein the bolt receiving receptacle has a sleeve which extends into the interior of the clamp member.

18. The electrical connector of claim 17, wherein the wedge member has a recess to receive the sleeve during termination.

19. The electrical connector of claim 12, wherein a hole extends through the web of the clamp member, a head of the bolt being received against the web and a threaded portion of the bolt being received within an interior of the clamp member, the bolt being received through a bottom of the wedge member to pull the wedge member into the interior of the clamp member.

20. The electrical connector of claim 19, wherein the hole which extends through the web is larger than the threaded portion of the bolt, the hole being threaded to receive a larger, second bolt to push the wedge member out of the interior of the clamp member following termination.

21. The electrical connector of claim 14, wherein the bolt receiving receptacle has a head which is received along an exterior of the clamp member and grooves which are received along an interior of the clamp member, a locking ring is received into the grooves to secure the bolt receptacle within the opening.

22. The electrical connector of claim 21, wherein the hole extends laterally toward side walls of the clamp member, the bolt receptacle being free to move from side to side so that the wedge member can be moved from side to side for ease of insertion of a cable into one of the opposing channels.

23. An electrical connector, comprising: a clamp member having opposing conductor receiving channels with a web therebetween the web including a resilient portion to provide enhanced resiliency;

a wedge member to be received within the clamp member between the opposing conductor receiving channels to secure conductors therein, the wedge being inserted into the clamp member in a direction perpendicular to the opposing conductor receiving channels, the wedge member being driven within the clamp member by a bolt, the bolt connecting the clamp member to the wedge member; and a spring member being received around the bolt to allow the wedge to be springably maintained against the clamp member.

24. An electrical connector, comprising:

a clamp member having two opposing channels for receiving conductors therein, the channels extending longitudinally along a length of the clamp member, the opposing channels being connected together by an intermediate portion, the intermediate portion having a web and an inner loop to provide inherent resiliency in the clamp member; and a wedge member to be received within the clamp member between the opposed channels, the wedge member being driven within the clamp member in a lateral direction by a bolt, the bolt connecting the clamp member to the wedge member, the bolt having a frangible portion which can be broken to remove excess length of the bolt following termination.

25. An electrical connector, comprising:

a clamp member having two opposing channels for receiving conductors therein, the channels extending longitudinally along a length of the clamp member, the opposing channels being connected together by an intermediate portion, the intermediate portion having a web and an inner loop to provide inherent resiliency in the clamp member, the clamp member having an opening along the web; and a wedge member to be received within the clamp member between the opposed channels, the wedge member being driven within the clamp member in a lateral direction by a bolt, the bolt connecting the clamp member to the wedge member, the opening having a bolt receiving receptacle therein to engage threads on the bolt and to secure the wedge member to the clamp member, the bolt receiving receptacle has a head which is received along an exterior of the clamp member and grooves which are received along an interior of the clamp member, a locking ring is received into the grooves to secure the bolt receptacle within the opening.

26. The electrical connector of claim 25, wherein the hole extends laterally toward side walls of the clamp member, the bolt receptacle being free to move from side to side so that the wedge member can be moved from side to side for ease of insertion of a cable into one of the opposing channels.

* * * * *